US006001752A

United States Patent [19]

Ishizawa et al.

[11] Patent Number: 6,001,752

[45] Date of Patent: Dec. 14, 1999

[54] MELT-ADHESIVE COMPOSITE FIBERS, PROCESS FOR PRODUCING THE SAME, AND FUSED FABRIC OR SURFACE MATERIAL OBTAINED THEREFROM

[75] Inventors: Sei Ishizawa, Moriyama; Masayasu Suzuki, Yasu-gun; Hirokazu Terada, Moriyama, all of Japan

[73] Assignee: Chisso Corporation, Osaka-fu, Japan

[21] Appl. No.: 09/038,327

[22] Filed: Mar. 11, 1998

Related U.S. Application Data

[62] Division of application No. 08/798,370, Feb. 10, 1997, Pat. No. 5,780,155, and application No. 08/501,309, Jul. 12, 1995, abandoned.

[30] Foreign Application Priority Data

Aug. 11, 1994 [JP] Japan ..... 6-210629

[51] Int. Cl.[6] ..... D02G 3/00

[52] U.S. Cl. ..... 442/632; 442/364

[58] Field of Search ..... 442/362, 364; 428/370, 373, 374

[56] References Cited

U.S. PATENT DOCUMENTS

| | | | |
|---|---|---|---|
| 4,189,338 | 2/1980 | Ejima et al. | 428/374 |
| 5,277,974 | 1/1994 | Kubo et al. | 428/375 |
| 5,418,045 | 5/1995 | Pike et al. | 442/362 |
| 5,456,982 | 10/1995 | Hansen et al. | 428/370 |
| 5,780,155 | 7/1998 | Ishizawa et al. | 428/370 |

*Primary Examiner*—N. Edwards

*Attorney, Agent, or Firm*—Fay, Sharpe, Fagan, Minnich & McKee

[57] ABSTRACT

Melt-adhesive composite fibers; non-woven fabrics from the composite fibers fused at intersectional points of the fibers; and surface materials for medical supplies such as sanitary napkins and paper diapers are disclosed. The composite fibers have a polypropylene as the first component and a polymer mainly composed of a polyethylene as the second component which is continuously present on at least a part of the fiber surface in the lengthwise direction of the fiber; have three-dimensional crimps of 4 to 16/inch; have a filamentary denier of 1.0 to 2.0, and have an apparent cut length of 20 to 40 mm. The composite fibers can be produced by extruding a polypropylene and a polymer mainly comprising a polyethylene through a spinneret for composite spinning to form unstretched composite filaments having such structure as mentioned above, stretching the unstretched composite filaments at a temperature of higher than 90° C., but lower than 130° C. at a stretching ratio of 0.60 to 0.85 time the maximum stretching ratio, cooling the stretched filaments to a temperature lower than a preheating temperature, subjecting the filaments to a crimping treatment, and subjecting the filaments to an annealing at a temperature of higher than 80° C., but lower than 120° C.

7 Claims, 1 Drawing Sheet

MELT-ADHESIVE COMPOSITE FIBERS, PROCESS FOR PRODUCING THE SAME, AND FUSED FABRIC OR SURFACE MATERIAL OBTAINED THEREFROM

This is a divisional of application Ser. No. 08/798,370 filed on Feb. 10, 1997, now U.S. Pat. No. 5,780,155, and, application Ser. No. 08/501,309 filed on Jul. 12, 1995, now abandoned.

BACKGROUND OF THE INVENTION

1. Field of the Invention

The present invention relates to melt-adhesive composite fibers and a process for producing the composite fibers. Further, the present invention relates to a partially fused fabric comprising the composite fibers and having a high strength, high bulk recovery from compression, excellent formation characteristics of few neps (small fiber aggregates), and soft hand feeling. Still further, the present invention relates to a surface material, for medical supplies such sanitary napkins and paper diapers, comprising the partially fused fabric.

2. Description of Related Art

In recent years, the performances required to non-woven fabrics used for surface materials for medical supplies such as sanitary napkins and paper diapers have been advanced and diversified; and specifically such non-woven fabrics have been required that the fabrics maintain a high strength at a basis weight as small as possible, have a high bulk recovery from compression, have limited number of naps (small fiber aggregates) as a formation characteristic of fabric, and have a soft hand feeling.

In order to satisfy these requirements, a process for producing a bulky non-woven fabric has been proposed in Examined Japanese Patent Publication No. 1-37505 wherein melt-adhesive composite fibers are partially fused, in the production of which fibers the Q value of the first component, preheating temperature, stretching ratio, number of crimps, and crimp elasticity are specified.

However, the non-woven fabric is still unsatisfactory as a surface material for medical supplies, and specifically the non-woven fabric obtained in the Publication '505 had the problems that troubles occur at the carding step; many neps are formed to deteriorate the fabric performances; bulk recovery is low; strength is low, and hand feeling is poor. Thus, the development of a non-oven fabric which solves such problems as mentioned above has strongly been desired.

SUMMARY OF THE INVENTION

As a result of diligent research on the performances of non-woven fabrics comprising melt-adhesive composite fibers and processes for producing such fabrics, it has been fund that the defects in the prior art have been solved by the present invention as follows:

The present invention is to provide melt-adhesive composite fibers comprising a first component comprising a crystalline polypropylene and a second component comprising mainly a polyethylene, the components being arranged in a side-by-side or sheath-core relationship wherein the second component is continuously present on at least a part of the fiber surface in the lengthwise direction of the fiber, having three-dimensional crimps of 4 to 16/inch, having a filamentary denier of 1.0 to 2.0, and having an apparent length of 20 to 40 mm.

The composite fibers of the present invention can be produced by conducting

- a step of spinning the polymer components by using a spinneret for a side-by-side or sheath-core type composite fiber,
- a step of stretching unstretched filaments thus obtained at a temperature of higher than 90° C., but lower than 130° C. at a stretching ratio of 0.60 to 0.85 time the maximum stretching ratio,
- a step of cooling the stretched filaments to a temperature lower than a preheating temperature and subjecting the filaments to a crimping treatment, and
- a step of subjecting the filaments to an annealing at a temperature of higher than 80° C., but lower than 120° C.

Further, the present invention is to provide a partially fused fabric comprising more than 50% by weight of the melt-adhesive composite fibers mentioned above or the fibers obtained by the process according to the process mentioned above. In the fabric of the present invention, intersectional points of the composite fibers are melted to join with each other through the second component in the composite fibers.

Still further, the present invention is to provide a surface material, for medical supplies, having a thickness of greater than 1 mm, and comprising the partially fused fabric mentioned above.

DETAILED DESCRIPTION OF THE INVENTION

Figure 1:
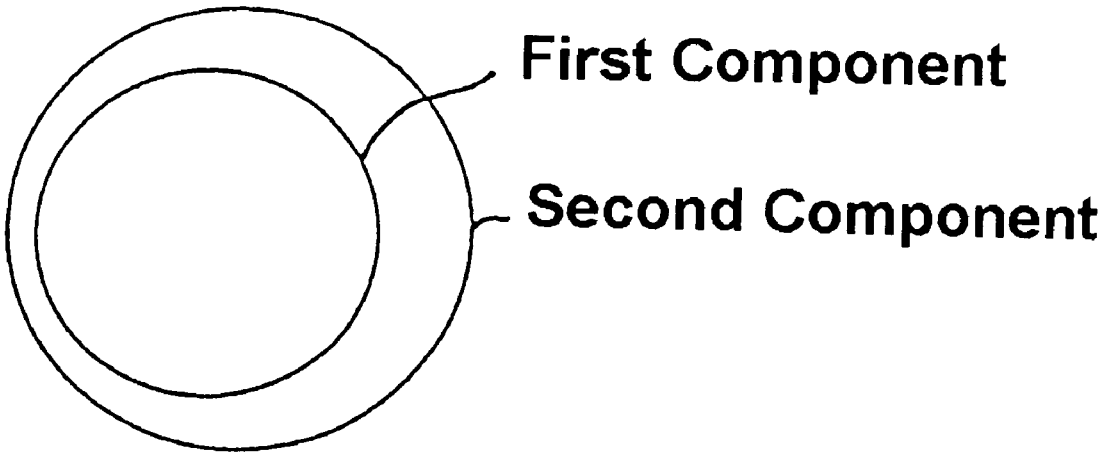
FIG. 1 shows a cross-section of a composite fiber of the present invention.

The crystalline polypropylene used as a first component in the composite fibers of the present invention generally means a crystalline polymer containing polymerized propylene as a main component, and includes not only homopolymers of propylene but also copolymers of propylene with ethylene, butene-1, or 4-methyl pentene.

The polyethylene used mainly as a second component in the composite fibers of the present invention generally means a polymer such as a medium or low pressure polyethlyene and high pressure polyethylene containing polymerized ethylene as main component, and includes not only homopolymers of ethylene but also copolymers with propylene, butene-1, or vinyl acetate (EVA). The melting point of the polyethylene is preferably lower than the melting point of the crystalline polypropylene as the first component by 20° C. or more.

The crystalline polypropylene and polyethylene mentioned above may contain various additives, generally used for polyolefin fibers, such as a stabilizer, filler, and pigment within a range wherein the object of the present invention is not failed to achieve.

The melt-adhesive composite fibers in the present invention are ones extruded from a spinneret for side-by-side type or sheath-core type composite fiber. The second component is necessary to be continuously present on at least a part of the fiber surface in the lengthwise direction of the fiber, and the second component preferably occupy the fiber surface as broadly as possible. Since the melt-adhesive composite fibers develop crimps by utilizing the difference in the elastic shrinkage of the two components, an eccentric sheath-core structure as shown in FIG. 1 is preferable in the case where the composite fibers have a sheath-core type structure, and the center of the core component is preferably biased by 5 to 15% (based on the diameter of the sheath-core composite fiber) from the center of sheath component.

The composite fibers of the present invention can be obtained by conventional methods for spinning a side-by-side composite fiber or sheath-core composite fiber wherein the second component is used as sheath component. There is not any specific restriction on the ratio of the two components in the composite fiber, but the second component is preferably 40 to 70% by weight.

The melt-adhesive composite fibers of the present invention have three-dimensional crimps. The composite fibers preferably do not develop crimps at the time of a heat treatment for preparing a non-woven fabric, in other words, the composite fibers of the present invention preferably do not have latent crimps. When the fibers do not substantially have latent crimps at the heat treatment, the shrinkage of the fibers caused by the developments of crimps at the time of the heat treatment for preparing the non-woven fabric can be avoided.

The number of crimps of the melt-adhesive composite fibers in the present invention is generally 4 to 16/inch, and preferably 6 to 14/inch. When the number of crimps is less than 4/inch, it causes winding of fibers on a cylinder of a carding machine. When the number of crimps exceeds 16/inch, the opening becomes inferior, and results in the formation of neps at the time of non-woven fabric preparation.

The melt-adhesive composite fibers of the present invention are necessary to have a filamentary denier of 1.0 to 2.0. When the denier is less than 1.0, crimps become too fine and causes the formation of naps. When the denier exceeds 2.0, there is a tendency that the hand feeling becomes hard and the bulk recovery of the non-woven fabric from compression decreases.

The apparent cut length of the melt-adhesive composite fibers of the present invention is generally 20 to 40 mm, and preferably 25 to 35 mm. When it is less than 20 mm, the transfer property of the fibers in carding machines is inferior and it becomes a cause of troubles that the fibers wind around workers. When it exceeds 40 mm, entanglement of the fibers becomes noticeable and becomes a cause of nap formation.

The melt-adhesive composite fibers of the present invention have preferably the ratio of apparent cut length to cut length of 50 to 70%. When the ratio is less than 50%, the transfer property of the fibers in carding machines is inferior, and the fibers wind around cylinders, resulting in a cause of nap formation. When the ratio exceeds 70%, entanglement of the fibers becomes too strong, winding of fibers on a taker-in roll is caused, and the carding step itself become impossible.

The method for producing the melt-adhesive composite fibers of the present invention comprises

- a step of spinning the polymer components through a spinneret for side-by-side or sheath-core type composite fibers,
- a step of stretching unstretched filaments thus obtained at a temperature of higher than 90° C., but lower than 130° C. at a stretching ratio of 0.60 to 0.85 time the maximum stretching ratio,
- a step of cooling the stretched filaments to a temperature lower than a preheating temperature and subjecting to a crimping treatment, and
- a step of subjecting the fiber to an annealing at a temperature of higher than 80° C., but lower than 120° C.

In the spinning step, the first component comprising a crystalline polypropylene and the second component comprising mainly a polyethylene are extruded through a spinneret for side-by-side or sheath-core type composite fibers to form filaments such that the second component continuously present on at least a part of the fiber surface.

In the stretching step, unstretched filaments as extruded are subjected to a preheating to a stretching temperature. When stretching temperature is lower than 90° C., crimps become too fine. When the stretching temperature exceeds 130° C., remarkable fusion of the composite fibers with each other unfavorably occur through the polyethylene.

When the stretching ratio is less than 0.60 time the maximum stretching ratio, the difference in elastic recovery of the two components become small and thus crimps are not developed. When the stretching ratio exceeds 0.85 time the maximum stretching ratio, the difference in elastic recovery of the two components become too large and the cycle of crimps become small. As the result, not only the number of crimps become too many and the apparent cut length of the fibers unfavorably become too short. The maximum stretching ratio means the stretching ratio at which fluffs begin to occur in filaments tow when the stretching ratio was gradually increased.

In the crimping treatment, stretched filaments are cooled at a temperature lower than the stretching temperature, the filaments are taken up with a roll such as a take-up roll of a nip roll under a tensioned condition, and then the filaments are relaxed to develop crimps. When the crimping treatment is carried out at a temperature exceeding the stretching temperature, development of crimps become insufficient.

In the annealing step, the filaments which developed crimps at the crimping treatment are subjected to an annealing at a temperature higher than 80° C., but lower than 120° C. for 0.5 to 30 min. When the annealing temperature is lower than 80° C., there is a fear that latent crimps are unfavorably developed at the step for preparing a non-woven fabric. When the annealing temperature is higher than 120° C., the crimps which were developed due to the difference in elastic recovery of the two components are extended and an apparent cut length of the fibers becomes unfavorably long.

The melt-adhesive composite fibers of the present invention are frequently cut to a predetermined length and used as staple fibers from the viewpoint of the easiness of processing to non-woven fabrics.

The partially fused fabric of the present invention may comprise more than 50% by weight, and up to 100% by weight of the melt-adhesive composite fibers mentioned above. The partially fused non-woven fabric can be obtained by converting the melt-adhesive composite fibers into a non-woven fabric by a conventional carding method, air-laid method, or dry-pulp method and then subjecting the non-woven fabric to a heat treatment to partially fuse the fabric. The partially fused non-woven fabric may comprise up to 50% by weight of polyester, polyamide, polypropylene, polyethylene, or other synthetic fibers, natural fibers such as cotton and wool, or regenerated fibers such as viscose rayon, as the fibers other than the melt-adhesive composite fibers. At this stage, the melt-adhesive composite fibers are necessary to be blended in an amount of 50% by weight or more in the fabric. When the content of the melt-adhesive composite fibers is less than 50% by weight, not only a fabric having a high non-woven strength can not be obtained since the fabric has few intersection of the fibers, but also a high bulkiness and a high bulk recovery of the fabric from compression as intended can not be obtained.

As the method for partially fusing the melt-adhesive composite fibers, a method by using a heated air dryer or suction band dryer can be exemplified. By applying these methods to the fabric, the intersections of the composite fibers are fused with each other through the melt of the second component to form a fabric. The temperature for the fusing is generally higher than the melting point of the second component, but lower than the melting point of the first component, and preferably 120 to 155° C. The time for the fusing is generally longer than 5 seconds when a dryer is used as an example.

The surface material for medical supplies of the present invention is one prepared by using the partially fused non-woven fabric, and usually has a thickness of greater than 1 mm. The surface material is desirable when the bulk characteristic is greater than 1 mm and elastic recovery from compression is higher than 50% in particular. When the thickness is less than 1 mm and the recovery is lower than 50%, a soft hand feeling of the material can not be obtained.

The thickness referred in this specification means the thickness (mm) which is determined by applying a load of 50 gf/cm$^2$ on the material for 24 hours, allowing the material to stand under no load for 1 hour to recover the thickness, and then measuring the thickness.(mm) under a load of 2 gf/cm$^2$. The elastic recovery from compression means the difference designated as percentage (%) in the thickness of a surface material measured after a load of 50 kgf/cm2 was applied for 24 hours and the thickness of the same surface material measured after the material was left to stand under no load for 1 hour to recover its thickness.

According to the present invention, melt-adhesive composite fibers can be produced, which have a high bulk recovery, good formation characteristics, high strength, and soft hand feeling at the same time, and thus are useful as a surface material for medical supplies. Specifically, the partially fused fabrics of the present invention can be widely used for sanitary napkins and paper diapers.

EXAMPLE

The present invention will be described in more specifically with reference to Examples. However, it should be understood that the present invention is by no means restricted by such specific Examples. The values of physical properties in the Examples were determined by the methods as follows:

Number of crimps: The number of crimps of the melt-adhesive composite fibers was determined according to JIS L1015 (Test method for chemical fiber staples) 7.12.1.

Filamentary denier: The filamentary denier of the melt-adhesive composite fibers was determined according to JIS L1015 (Test method for chemical fiber staples) 7.5.1-A.

Apparent cut length: The apparent cut length of the melt-adhesive composite fibers was determined by measuring the fiber length (mm) under no tension without extending the crimps of the staples and without applying an extra force to the staples. The average value of 30 times of measurements was obtained.

Bulk recovery: The bulk recovery of the partially fused non-woven fabric was determined by measuring the thickness (A) of a sample fabric after a load of 50 gf/cm$^2$ was applied for 24 hours on the fabric, allowing the fabric to stand for 1 hour under no load to recover its bulk, measuring the thickness (B) of the fabric under a load of 2 gf/cm$^2$, and calculating the bulk recovery according to the following equation:

$$\text{Bulk recovery (\%)} = \frac{\text{thickness (B)} - \text{thickness (A)}}{\text{thickness (B)}} \times 100$$

In evaluating the results, the fabrics having a bulk recovery of 50% or higher were regarded as acceptable and other fabrics were regarded as unaccetptable. Acceptable fabrics were designated as A and unacceptable fabrics were designated as C.

Strength of non-woven fabric: The strength of partially fused non-woven fabrics was determined according to JIS L1085 (Test for interlining cloth of non-woven fabric) in which a sample fabric of 5 cm wide was subjected to measuring for strength in the fabric direction (MD) and the direction perpendicular to the fabric direction (CD) by stretching the fabric under the conditions of a grip distance of 10 cm and a stretch rate of 30±2 cm/min. In evaluating the results, the fabrics having a MD strength of 2500 g/5 cm or higher were regarded as acceptable and lower than 2500 g/5 cm as unacceptable; and the fabrics hiving a CD strength of 500 g/5 cm or higher were regarded as acceptable and lower than 500 g/5 cm as unacceptable. Acceptable fabrics were designated as A and unacceptable fabrics were designated as C.

Number of naps: The number of naps of the partially fused non-woven fabrics was determined by counting the number of naps in 1 m$^2$ of a sample fabric, and designated as the number/m$^2$. In the evaluation, partially fused non-woven fabrics having one nap or less were regarded as acceptable and two or more as unacceptable. Acceptable fabrics were designated as A and unacceptable fabrics were designated as C.

Hand feeling: The hand feeling of the partially fused non-woven fabrics was determined by conducting sensory tests by 5 panelists. When all panelists judged a sample fabric as soft, the fabric was regarded as "excellent"; when 3 or more panelists judged a sample fabric as soft, the fabric was regarded as "good"; and when 3 or more panelists judged a sample fabric as insufficient in soft feeling, the fabric was regarded as "poor". Excellent fabrics were designated as A, good fabrics were designated as B, and poor ones were as C.

Fabric shrinkage: The shrinkage of the partially fused non-woven fabrics was determined by cutting a sample fabric into a size of 25 cm square, heating the fabric at 145° C. for 5 min under no load with a dryer, measuring the shrinkage in the fabric direction at three points, and obtain the average value by calculation. In the evaluation, the fabrics having a shrinkage of lower than 10% were regarded as acceptable and the fabrics having a shrinkage of 10% or higher were regarded as unacceptable. Acceptable fabrics were designated as A and unacceptable fabrics were designated as C.

Example 1 to 4 and Comparative Example 1 to 9

Each of the melt-adhesive composite fiber staples shown in Table 1 was obtained by extruding a polypropylene as the first component and a polyethylene as the second component through a spinneret having 350 orifices of a diameter of 0.6 mm for sheath-core or side-by-side type composite fiber to form filaments, stretching the filaments under the conditions shown in Table 1, and then cutting the stretched filaments into staples. The physical properties of the fibers thus obtained are shown in Table 1.

The staples of each of the melt-adhesive composite fibers thus obtained were formed into a web having a basis weight of 20 to 30 g/m$^2$ by means of a carding machine, and the web was subjected to a heat treatment at a predetermined temperature of 135 to 140° C. for 5 sec with a suction band dryer to obtain a non-woven fabric in which intersections of the fibers were fused each other. The characteristics of the fabrics are shown in Table 2. In the Example 4 and Comparative Example 9 in Table 2, the staples in Example 1 and Comparative Example 3 were used.

TABLE 1

Physical properties of melt-adhesive composite fibers

| | First component | Second component | Composite structure | Composite ratio 1st/2nd components | Stretching temperature ° C. | Cooling temperature ° C. | Annealing temperature ° C. |
|---|---|---|---|---|---|---|---|
| Ex. 1 | PP[2)] | PE[3)] | Sheath-core | 50/50 | 115 | 50 | 100 |
| Comp. Ex. 1 | " | " | " | " | " | " | 130 |
| Comp. Ex. 2 | " | " | " | " | " | " | 100 |
| Comp. Ex. 3 | " | " | " | " | " | " | " |
| Comp. Ex. 4 | " | " | " | " | 110 | 80 | 80 |
| Comp. Ex. 5 | " | " | " | " | " | " | " |
| Comp. Ex. 6 | " | " | " | " | 115 | 50 | 100 |
| Ex. 2 | " | LL[4)] | " | 40/60 | 95 | 40 | 80 |
| Comp. Ex. 7 | " | " | " | " | " | " | " |
| Ex. 3 | " | PE[3)] | Side-by side | 50/50 | 110 | 100 | 100 |
| Comp. Ex. 8 | " | " | " | " | " | 60 | 60 |

| | Actual stretching ratio | Maximum stretching ratio | MS ratio[1)] | Number of crimps/inch | Crimp form | Filamentary denier | Cut length mm | Apparent cut length mm |
|---|---|---|---|---|---|---|---|---|
| Ex. 1 | 4.0 | 4.8 | 0.83 | 11.3 | Three-dimensional | 1.5 | 51 | 34 |
| Comp. Ex. 1 | " | " | " | 3.5 | Three-dimensional | " | " | 43 |
| Comp. Ex. 2 | 4.4 | " | 0.92 | 18.2 | Three-dimensional | " | " | 21 |
| Comp. Ex. 3 | 4.0 | " | 0.83 | 12.7 | Machine[5)] | " | " | 29 |
| Comp. Ex. 4 | 3.2 | 3.5 | 0.91 | 16.0 | Three-dimensional | 0.8 | " | 22 |
| Comp. Ex. 5 | 2.0 | " | 0.57 | 3.1 | Three-dimensional | 1.5 | " | 43 |
| Comp. Ex. 6 | 4.0 | 4.8 | 0.83 | 11.3 | Three-dimensional | " | 64 | 44 |
| Ex. 2 | " | 5.1 | 0.78 | 13.3 | Three-dimensional | 2.0 | 51 | 28 |
| Comp. Ex. 7 | 3.3 | " | 0.64 | 13.9 | Three-dimensional | 3.0 | " | 25 |
| Ex. 3 | 3.4 | 3.9 | 0.87 | 6.5 | Three-dimensional | 1.0 | 38 | 26 |
| Comp. Ex. 8 | " | 3.8 | 0.89 | 15.1 | Three-dimensional | " | " | 17 |

[2)]PP: Crystalline polypropyelene
[3)]PE: High density polyethylene
[4)]LL: Linear low density polyethylene
[1)]MS ratio: Actual stretching ratio ÷ maximum stretching ratio
[5)]Machine: Crimp form obtained using a stuffing box

TABLE 2

Physical properties of fused non-woven fabrics

| | Content | Basis weight | Bulkiness | | | Strength characteristics | |
|---|---|---|---|---|---|---|---|
| | | | Thickness | Bulk recovery | | | |
| | % | g/m$^2$ | mm | % | Evaluation | MD g/5 cm | Evaluation |
| Ex. 1 | 100 | 25 | 2.0 | 61 | A | 2840 | A |
| Comp. Ex. 1 | Fibers of Comp. Ex. 1 were unable to form into a non-woven fabric. | | | | | | |
| Comp. Ex. 2 | 100 | 25 | 1.9 | 68 | A | 2520 | A |
| Comp. Ex. 3 | " | " | 0.7 | 38 | C | 3150 | A |
| Comp. Ex. 4 | " | " | 1.7 | 57 | A | 2720 | A |
| Comp. Ex. 5 | Fibers of Comp. Ex. 5 were unable to form into a non-woven fabric. | | | | | | |
| Comp. Ex. 6 | 100 | 25 | 1.6 | 60 | A | 2670 | A |
| Ex. 2 | " | 30 | 2.2 | 53 | A | 3200 | A |
| Comp. Ex. 7 | " | " | 1.4 | 32 | C | 2200 | C |
| Ex. 3 | " | 20 | 1.3 | 55 | A | 2610 | A |
| Comp. Ex. 8 | " | " | 1.0 | 62 | A | 2550 | A |

TABLE 2-continued

| Physical properties of fused non-woven fabrics | | | | | | | |
|---|---|---|---|---|---|---|---|
| Ex. 4 | 50[6)] | 25 | 1.3 | 51 | A | 2950 | A |
| Comp. Ex. 9 | 30[7)] | " | 1.0 | 45 | C | 3030 | A |

| | Strength characteristics | | Formation characteristics | | | | Hand |
|---|---|---|---|---|---|---|---|
| | | | Naps | | Fabric shrinkage | | feel- |
| | CD g/5 cm | Evaluation | number/m$^2$ | Evaluation | % | Evaluation | ing |
| Ex. 1 | 610 | A | 0 | A | 3.1 | A | A |
| Comp. Ex. 1 | Fibers of Comp. Ex. 1 were unable to form into a non-woven fabric. | | | | | | |
| Comp. Ex. 2 | 590 | A | 13 | C | 4.7 | A | B |
| Comp. Ex. 3 | 780 | A | 0 | A | 2.9 | A | C |
| Comp. Ex. 4 | 510 | A | 38 | C | 6.3 | A | B |
| Comp. Ex. 5 | Fibers of Comp. Ex. 5 were unable to form into a non-woven fabric. | | | | | | |
| Comp. Ex. 6 | 500 | A | 9 | C | 3.2 | A | B |
| Ex. 2 | 630 | A | 1 | A | 2.0 | A | A |
| Comp. Ex. 7 | 450 | C | 0 | A | 1.8 | A | C |
| Ex. 3 | 550 | A | 0 | A | 2.9 | A | A |
| Comp. Ex. 8 | 540 | A | 57 | C | 13.1 | C | B |
| Ex. 4 | 640 | A | 0 | A | 2.8 | A | A |
| Comp. Ex. 9 | 660 | A | 0 | A | 2.8 | A | B |

[6)]Fibers of Example 1 (50%) were blended with fibers of Comp. Ex. 3 (50%).
[7)]Fibers of Example 1 (30%) were blended with fibers of Comp. Ex. 3 (70%).

What is claimed is:

1. A partially fused non-woven fabric comprising more than 50% by weight of the melt-adhesive composite fibers, said melt-adhesive composite fiber comprising a first component comprising a crystalline polypropylene and a second component consisting essentially of a polyethylene, the components being arranged in a side-by-side or sheath-core relationship wherein the second component is continuously present on at least a part of the fiber surface in the lengthwise direction of the fiber, said composite fiber having helical crimps of 4 to 16/inch, a filamentary denier of 1.0 to 2.0, and an apparent cut length of 20 to 40 mm corresponding to a cut length of 28 to 80 mm, said composite fibers being subjected to a card processing, and intersectional points of said composite fibers being melted to join with each other through the second component in the composite fibers.

2. A partially fused non-woven fabric according to claim 1, wherein the apparent cut length of said melt-adhesive composite fiber is in the range of 25 to 35 mm.

3. A partially fused non-woven fabric according to claim 1, wherein the ratio of the apparent cut length to the cut length of said composite fiber is in the range of 0.5 to 0.7.

4. A partially fused non-woven fabric according to claim 2, wherein the ratio of the apparent cut length to the cut length of said composite fiber is in the range of 0.5 to 0.7.

5. A surface material, for medical supplies, having a thickness of greater than 1 mm, comprising the partially fused non-woven fabric according to claim 1.

6. A surface material, for medical supplies, having a thickness of greater than 1 mm, comprising the partially fused non-woven fabric according to claim 2.

7. A surface material, for medical supplies, having a thickness of greater than 1 mm, comprising the partially fused non-woven fabric according to claim 3.

* * * * *